US007793807B2

(12) United States Patent
Goujon et al.

(10) Patent No.: US 7,793,807 B2
(45) Date of Patent: Sep. 14, 2010

(54) METERING VALVE AND A FLUID DISPENSER DEVICE INCLUDING SUCH A VALVE

(75) Inventors: David Goujon, Saint Leger du Bourg Denis (FR); Christophe Jacuk, Ande (FR); Christophe Marie, Caen (FR); Frederic Pirou, Louviers (FR)

(73) Assignee: Valois S.A.S., Le Neubourg (FR)

( * ) Notice: Subject to any disclaimer, the term of this patent is extended or adjusted under 35 U.S.C. 154(b) by 871 days.

(21) Appl. No.: 10/574,421

(22) PCT Filed: Oct. 4, 2004

(86) PCT No.: PCT/FR2004/050482

§ 371 (c)(1),
(2), (4) Date: Jan. 26, 2007

(87) PCT Pub. No.: WO2005/032971

PCT Pub. Date: Apr. 14, 2005

(65) Prior Publication Data

US 2007/0145081 A1 Jun. 28, 2007

(30) Foreign Application Priority Data

Oct. 7, 2003 (FR) ..... 03 11720

(51) Int. Cl.
*B65D 83/54* (2006.01)

(52) U.S. Cl. ..... 222/402.2

(58) Field of Classification Search ..... 222/402.1, 222/402.2, 448

See application file for complete search history.

(56) References Cited

U.S. PATENT DOCUMENTS

| | | | | |
|---|---|---|---|---|
| 3,405,846 | A * | 10/1968 | Klun | 222/402.2 |
| 4,744,495 | A * | 5/1988 | Warby | 222/402.2 |
| 4,953,759 | A * | 9/1990 | Schmidt | 222/402.2 |
| 6,622,893 | B2 | 9/2003 | Leone et al. | |

FOREIGN PATENT DOCUMENTS

FR 1 528 439 A 6/1968

* cited by examiner

*Primary Examiner*—Kevin P Shaver
*Assistant Examiner*—Jonathan Wood
(74) *Attorney, Agent, or Firm*—Sughrue Mion, PLLC

(57) ABSTRACT

A metering valve for dispensing fluid, the metering valve having a valve body (10), a metering chamber (20), and a valve member (30) that is slidable in the valve body (10) so as to dispense the fluid contained in the metering chamber (20). The wall (27) of the metering chamber (20) is curved, at least in part, in axial section.

17 Claims, 1 Drawing Sheet

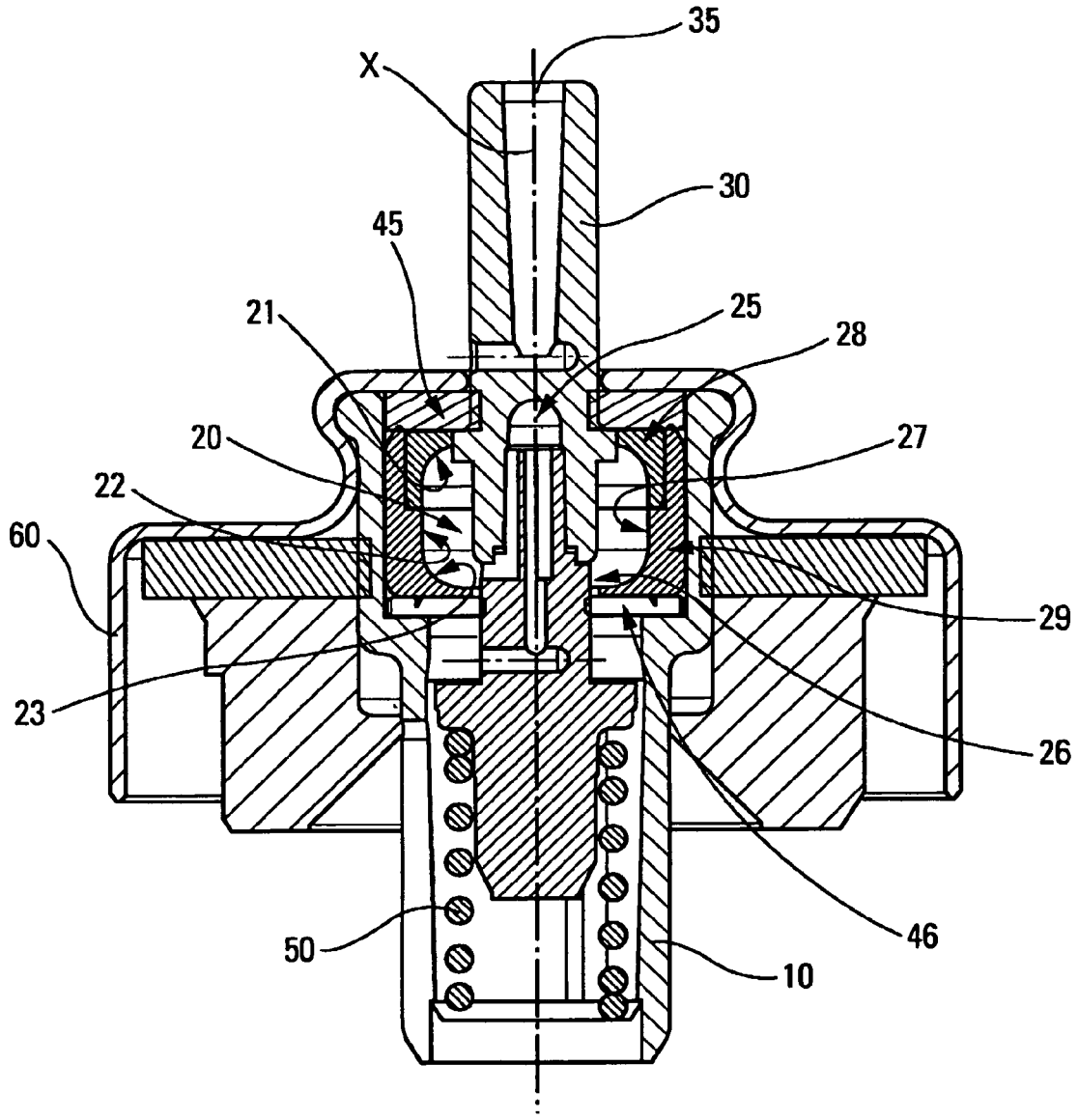
Sole figure

METERING VALVE AND A FLUID DISPENSER DEVICE INCLUDING SUCH A VALVE

FIELD OF INVENTION

The present invention relates to a metering valve and to a fluid dispenser device including such a valve.

BACKGROUND

Metering valves are well known and they generally comprise a valve body in which a valve member slides between a rest position and a dispensing position. The valve includes a metering chamber that defines a quantity or "dose" of fluid that is to be dispensed on each actuation of the valve. The metering chamber is generally connected to the dispenser orifice of the valve member while said valve member is in its dispensing position, and it is filled with the fluid contained in the reservoir while the valve member is returning from its dispensing position to its rest position. Generally, the metering chamber is formed by a cylindrical tubular element associated with two horizontal annular walls that define the axial ends of said metering chamber, each including a central through hole for the valve member. To ensure that the valve member is displaced in leaktight manner relative to the metering chamber, the two through holes are generally associated with sealing gaskets. A well known problem with metering valves relates to the reproducibility or repetitivity of the metered dose,. i.e. a metered dose that is accurate and identical on each actuation. Conventional metering chambers present a drawback in that they define a corner or an angle at the junction between the cylindrical tube and each of the horizontal annular wall elements. The fluid contained in the metering chamber, generally a fluid containing a propellant gas, is capable of forming a meniscus at the angles or corners of the metering chamber. This causes propellant and active fluid to be retained at the meniscuses, and therefore spoils the accuracy of the metered dose. In addition, that type of meniscus causes fluid to adhere to the walls of the chamber, which also spoils the uniformity of the metered dose. In particular, when a metering valve is actuated, the user presses axially on the valve member, and holds it in its dispensing position for a limited period of time. If the metering chamber presents a meniscus during actuation, then actuating the valve member relatively rapidly would not enable the entire dose contained in the metering chamber to be dispensed. In this event, in order to improve metering accuracy, it is necessary to hold the valve member driven in, in its dispensing position, for a relatively long period of time, typically several seconds, and that constitutes a significant drawback.

CERTAIN OBJECTS OF THE INVENTIONS

An object of the present invention is to provide a fluid dispenser valve that does not have the above-mentioned drawbacks.

More particularly, an object of the present invention is to provide a metering valve for dispensing fluid that guarantees good reproducibility of the metered dose on each actuation of the valve.

Another object of the present invention is to provide a metering valve for dispensing fluid that improves the uniformity of the metered dose on each actuation of the valve.

Another object of the present invention is to provide a metering valve for dispensing fluid that is simple and inexpensive to manufacture and to assemble, and that is safe and reliable on each actuation.

The present invention thus provides a metering valve for dispensing fluid, the metering valve comprising a valve body, a metering chamber, and a valve member that is slidable in said valve body so as to dispense the fluid contained in the metering chamber, the wall of said metering chamber being curved, at least in part, in axial section.

Advantageously, said metering chamber includes a top orifice, and a bottom orifice, said valve member passing through said top and bottom orifices, a circularly-cylindrical wall defining said metering chamber by interconnecting said top and bottom orifices, said circularly-cylindrical wall being curved or rounded, at least in part, so that it does not form any angles.

Advantageously, said circularly-cylindrical wall comprises a middle wall portion, a top wall portion that connects the middle wall portion to said top orifice, and a bottom wall portion that connects the middle wall portion to said bottom orifice.

Advantageously, said middle wall portion is cylindrical.

Advantageously, said top wall portion is rounded, in particular spherical.

Advantageously, said bottom wall portion is rounded, in particular spherical.

Advantageously, said metering chamber is formed by two wall elements that are fastened to each other in leaktight manner.

Advantageously, the top and bottom orifices include respective sealing gaskets, said wall elements substantially covering said gaskets so as to limit the contact area between said gaskets and the fluid contained in said metering chamber, and/or so as to limit the degree to which the gaskets move during actuation.

The present invention also provides a fluid dispenser device including a metering valve as described above.

BRIEF DESCRIPTION OF DRAWING

Other characteristics and advantages of the present invention appear more clearly from the following detailed description of a particular embodiment thereof, given by way of non-limiting example, and with reference to the accompanying drawing in which the sole FIGURE is a diagrammatic section view of a metering valve constituting an advantageous embodiment of the present invention.

DETAILED DESCRIPTION OF AN EMBODIMENT OF INVENTION

With reference to sole FIGURE, the valve comprises a valve body 10, and a valve member 30. A metering chamber 20 is defined in the valve, and the valve member 30 slides relative to the valve body 10 between a rest position (shown in the figure) and a dispensing position (not shown) in which the valve member is driven axially into the valve body 10. The metering valve is for assembling on a fluid reservoir (not shown), e.g. by means of a fastener ring or cap 60 that can be of any type. In conventional manner, the metering chamber 20 is isolated from the reservoir while the valve member 30 is being displaced towards its dispensing position in which the inside of the metering chamber 20 is connected to the dispenser orifice 35 of the valve member 30. When the user releases the pressure on the valve member 30, said valve member automatically returns to its rest position under the effect of the return spring 50, and during this return, the metering chamber 20 is connected to the reservoir in any known manner, making it possible to fill the metering chamber under the effect of the suction created by the preceding dose being dispensed, and/or by gravity if said valve is used upsidedown.

In the invention, the metering chamber 20 is curved, at least in part, in axial section. The term "axial section" refers to a section plane that includes the central axis X of the valve, as shown in the figure. More precisely, as can be seen in the sole figure, the metering chamber 20 includes a circularly-cylindrical wall (27) that connects the top orifice 25 to the bottom orifice 26, the valve member 30 passing through the top and bottom orifices while it is being displaced between its rest and dispensing positions. The circularly-cylindrical wall 27 is advantageously curved or rounded, at least in part, so that it does not form any angles. The term "curved or rounded" means that the wall includes substantially no sharp angles or edges, as would occur with a polygonal surface, for example. The absence of any angles or corners in the metering chamber makes it possible to avoid the formation of a meniscus, thereby making it possible to improve the reproducibility and uniformity of the metered dose on each actuation of the valve.

The circularly-cylindrical wall 27 advantageously includes a middle wall portion 22 that can advantageously be cylindrical. The middle wall portion 22 is connected to the top orifice 25 via a top wall portion 21, and to the bottom orifice 26 via a bottom wall portion 23. The top and/or bottom wall portions are preferably rounded or curved, in particular spherical or elliptical, so as to avoid any formation of meniscus at these points.

In the embodiment shown in the sole figure, the metering chamber 20 is in fact formed by two wall elements 28, 29 that are fastened to each other in leaktight manner. Each wall element can therefore be both rounded, curved, or spherical in part, and cylindrical in part.

This embodiment further presents another advantage, namely that the sealing gaskets 45, 46 that are associated with the top and bottom orifices 25, 26, and against which the valve member 30 slides while it is being displaced, are substantially covered by said curved wall elements 28 and 29, thereby limiting the contact area between said gaskets 45, 46 and the fluid contained in said metering chamber 20. This can have a beneficial effect depending on the nature of the fluid to be dispensed, and in particular when the fluid is a pharmaceutical. In addition, during actuation, the movement of the sealing gaskets is advantageously limited by the presence of the rounded top and bottom walls.

The present invention is described above with reference to a particular embodiment thereof. Naturally, various modification can be envisaged. For example, the structure of the valve, and in particular of the valve body or of the valve member could be modified. In addition, the rounded shape of the metering chamber could be different from the shape shown, providing it avoids forming any meniscus, and therefore avoids the presence of any corners, edges, or angles that would favor such a creation of meniscus. Other modifications can also be envisaged by the person skilled in the art, without going beyond the ambit of the present invention, as defined by the accompanying claims.

The invention claimed is:

1. A metering valve for dispensing fluid, the metering valve comprising a valve body (10), a metering chamber (20), and a valve member (30) that is slidable in said valve body (10) so as to dispense the fluid contained in the metering chamber (20), said metering chamber (20) comprising a top orifice (25), and a bottom orifice (26), said valve member (30) passing through said top and bottom orifices (25, 26), a circularly-cylindrical wall (27) defining said metering chamber (20) by interconnecting said top and bottom orifices (25, 26), said metering chamber comprising two curved portions that are curved or rounded radially inwardly, at least in part, in an axial section so as to be concave with respect to the inside of the metering chamber and so that said curved portions do not form any angles; one of the curved portions located axially between the top orifice and the circularly-cylindrical wall and the other curved portion located axially between the bottom orifice and the circularly-cylindrical wall.

2. A metering valve according to claim 1, wherein the curved portion located axially between the top orifice and the circularly-cylindrical wall is a top wall portion that connects the top orifice to the circularly-cylindrical wall, and wherein the curved portion located axially between the bottom orifice and the circularly-cylindrical wall is a bottom wall portion that connects the bottom orifice to the circularly-cylindrical wall.

3. A metering valve according to claim 2, in which said top wall portion (21) is rounded.

4. A metering valve according to claim 2, in which said bottom wall portion (23) is rounded.

5. A metering valve according to claim 2, in which said top wall portion is spherical.

6. A metering valve according to claim 2, in which said bottom wall portion is spherical.

7. A metering valve according to claim 1, in which said metering chamber (20) is formed by two wall elements (28, 29) that are fastened to each other in leaktight manner.

8. A metering valve according to claim 7, in which the top and bottom orifices (25, 26) include respective sealing gaskets (45, 46), said wall elements (28, 29) substantially covering said gaskets (45, 46), respectively so as to limit the contact area between said gaskets (45, 46) and the fluid contained in said metering chamber (20).

9. A metering valve according to claim 8, in which said wall elements substantially cover said gaskets, respectively so as to limit the degree to which the gaskets move during actuation.

10. A metering valve according to claim 7, in which the top and bottom orifices include respective sealing gaskets, said wall elements substantially covering said gaskets, respectively so as to limit the degree to which the gaskets move during actuation.

11. A fluid dispenser device, characterized in that it includes a metering valve according to claim 1.

12. A metering valve for dispensing fluid, comprising:

a valve body;

a metering chamber comprising a top orifice and a bottom orifice;

a valve member in the valve body and slidable through the top orifice and the bottom orifice so as to dispense the fluid from the metering chamber;

an inside of the metering chamber bounded at least in part by a cylindrical wall portion, a top curved portion and a bottom curved portion, the cylindrical wall portion axially disposed between the top curved portion and the bottom curved portion;

the top curved portion curved radially inwardly in an axial section so as to be concave with respect to the inside of the metering chamber; and the bottom curved portion curved radially inwardly in an axial section so as to be concave with respect to the inside of the metering chamber.

13. The metering valve according to claim 12, wherein the top curved portion does not form an angle and the bottom curved portion does not form a sharp angle or corner.

14. The metering valve according to claim 12, wherein the top curved portion extends to the top orifice and the bottom curved portion extends to the bottom orifice.

15. The metering valve according to claim 12, wherein the top curved portion connects the top orifice to the cylindrical wall portion and the bottom curved portion connects the bottom orifice to the cylindrical wall portion.

16. The metering valve according to claim 12, wherein the metering chamber is formed by two wall elements fastened to each other in leaktight manner.

17. The metering valve according to claim 16, wherein the top orifice and the bottom orifice have respective sealing gaskets, the wall elements substantially covering the gaskets, respectively so as to limit contact area between the gaskets and fluid contained in the metering chamber.

* * * * *